US007878127B2

(12) United States Patent
Hedstrom

(10) Patent No.: US 7,878,127 B2
(45) **Date of Patent: *Feb. 1, 2011**

(54) PALLET WITH OPTIMIZED CARGO LAYER AND RELATED METHODS

(75) Inventor: Kristen Karl Hedstrom, Orlando, FL (US)

(73) Assignee: Chep Technology Pty Limited, Sydney (AU)

( * ) Notice: Subject to any disclaimer, the term of this patent is extended or adjusted under 35 U.S.C. 154(b) by 881 days.

This patent is subject to a terminal disclaimer.

(21) Appl. No.: 11/678,814

(22) Filed: Feb. 26, 2007

(65) Prior Publication Data

US 2007/0204766 A1 Sep. 6, 2007

Related U.S. Application Data

(60) Provisional application No. 60/777,434, filed on Feb. 28, 2006, provisional application No. 60/828,522, filed on Oct. 6, 2006.

(51) Int. Cl.
*B65D 19/00* (2006.01)

(52) U.S. Cl. ..... 108/56.3; 108/57.17

(58) Field of Classification Search ..... 108/51.11, 108/56.1, 56.3, 57.17, 57.21; 52/177, 263; 114/264–266; 405/218–221; 206/386, 599, 206/600

See application file for complete search history.

(56) References Cited

U.S. PATENT DOCUMENTS

| | | | | | |
|---|---|---|---|---|---|
| 2,693,926 | A | * | 11/1954 | Tatko | 108/55.1 |
| 2,967,036 | A | | 5/1959 | Phillips | 248/120 |
| 2,919,090 | A | | 12/1959 | De Pew | 248/120 |
| 3,126,843 | A | | 3/1964 | De Laney | 108/52 |
| 3,855,945 | A | * | 12/1974 | Sebilleau et al. | 108/57.1 |
| 3,910,203 | A | | 10/1975 | Hamkins et al. | 108/51 |
| 4,159,681 | A | | 7/1979 | Vandament | 108/51.1 |
| 4,220,099 | A | | 9/1980 | Marchesano | 108/51.1 |
| 4,240,358 | A | | 12/1980 | Munroe | 108/51.1 |
| D287,911 | S | * | 1/1987 | Teixeira | D6/382 |
| 4,715,294 | A | * | 12/1987 | Depew | 108/57.17 |
| D306,226 | S | | 2/1990 | Jirucha | D34/38 |
| 5,076,175 | A | | 12/1991 | Whatlet, II | 108/51.1 |

(Continued)

FOREIGN PATENT DOCUMENTS

FR 2660283 10/1991

(Continued)

*Primary Examiner*—Janet M Wilkens
(74) *Attorney, Agent, or Firm*—Allen, Dyer, Doppelt, Milbrath & Gilchrist, P.A.

(57) ABSTRACT

A pallet includes a cargo layer for supporting different size cargo cases. The cargo layer includes a pair of spaced apart end deck boards, with each end deck board having a first width. Spaced apart intermediate deck boards are positioned in a pattern between the pair of spaced apart end deck boards for providing deck coverage for the different size cargo cases. The pattern is defined by two pairs of first and second intermediate deck boards, with each intermediate deck board in each pair having a second width. Each pair of intermediate deck boards is adjacent one of the end deck boards. A pair of third intermediate deck boards is between the two pairs of intermediate deck boards, with each third intermediate deck board having a third width. A fourth intermediate deck board is between the pair of third intermediate deck boards, and has the second width.

24 Claims, 5 Drawing Sheets

U.S. PATENT DOCUMENTS

| | | | | | |
|---|---|---|---|---|---|
| 5,351,628 | A | * | 10/1994 | Breezer et al. | 108/56.1 |
| 5,673,629 | A | | 10/1997 | Ginnow | 108/51.1 |
| D390,317 | S | | 2/1998 | Fenton | D34/38 |
| 5,809,902 | A | | 9/1998 | Zetterberg | 108/51.1 |
| 5,865,315 | A | * | 2/1999 | Uitz | 206/600 |
| 5,960,721 | A | * | 10/1999 | Huetteman et al. | 108/57.17 |
| 6,003,448 | A | | 12/1999 | Skuse | 108/51.11 |
| 7,219,609 | B1 | * | 5/2007 | Utz et al. | 108/57.21 |
| 7,487,730 | B2 | * | 2/2009 | Hedstrom | 108/56.3 |
| 7,516,705 | B2 | * | 4/2009 | Hedstrom | 108/56.3 |
| 2006/0005746 | A1 | | 1/2006 | Gouldin, Jr. | 108/51.11 |

FOREIGN PATENT DOCUMENTS

| | | |
|---|---|---|
| GB | 2288783 | 11/1995 |
| JP | 9165039 | 6/1997 |
| WO | 2004/106179 | 12/2004 |

* cited by examiner

PALLET WITH OPTIMIZED CARGO LAYER AND RELATED METHODS

RELATED APPLICATIONS

This application claims the benefit of U.S. Provisional Application Ser. Nos. 60/777,434 filed Feb. 28, 2006 and 60/828,522 filed Oct. 6, 2006, the entire contents of which are incorporated herein by reference.

FIELD OF THE INVENTION

The present invention relates to the field of pallets, and more particularly, to a pallet having a cargo layer optimized for carrying different size cargo cases, and to related methods for making the same.

BACKGROUND OF THE INVENTION

Conventional pallets include a base layer and a cargo layer separated therefrom by support blocks. Traditionally, the base and cargo layers respectively have end deck boards of a common thickness assembled on connector boards that run the full length or width of the pallet. The end deck boards are nailed through the connector boards into the support blocks to build the primary structure of the pallet. Intermediate deck boards are placed between the end deck boards. The end deck boards are also known as lead boards.

To move the pallet with cargo thereon, forklift tines are inserted into the gaps between the base and cargo layers. If the forklift is not stopped in time, the forklift may crash into one of the end deck boards of the pallet. The end deck board may not be able to withstand such an impact over time. Accidents such as this weaken the pallet and greatly shorten the lifespan of the pallet, thereby causing the pallet to be repaired more frequently and/or removed from service long before its anticipated life cycle has been reached.

In an effort to improve pallet durability, an intermediate deck board may butt up against an end deck board to help resist impacts from material handling equipment. While this technique is effective at generating more resistance, the effect of a failure is often two boards being broken instead of just one.

Another approach is disclosed in U.S. Pat. No. 4,220,099 to Marchesano. The '099 patent discloses a pallet comprising at least two runners, and a plurality of deck boards or stringers coupled to the runners. In particular, the end deck boards in the cargo layer are dadoed or undercut into the runners to thereby strengthen the pallet. The end deck boards in the base layer are received in recessed portions of the runners so that they butt up against the runners. This may be effective in strengthening the pallet, but undercutting the end deck boards for the cargo layer and the corresponding runners is a time consuming process, and as a result, adds to the expense of building a pallet.

With respect to pooled pallets, one of the goals is to minimize the gaps between the deck boards in the cargo layer so that there is a greater probability of properly supporting the different available size cargo cases or products that may be placed thereon. Pooled pallets generally have a high percentage of deck coverage that, in effect, takes a shotgun approach to supporting the loads placed thereon. Alternatively, custom pallet designs exist that align board placement with specific products. The true need of the pallet's top deck boards is to provide support to the corners of the cargo cases where the case strength is greatest.

SUMMARY OF THE INVENTION

In view of the foregoing background, it is therefore an object of the present invention to determine size and placement of the deck boards in a cargo layer to achieve corner support for common cargo case sizes.

This and other objects, features, and advantages in accordance with the present invention are provided by cargo layer for supporting a plurality of different size cargo cases. The cargo layer may comprise a pair of spaced apart end deck boards, with each end deck board having a first width, and a plurality of spaced apart intermediate deck boards positioned in a pattern between the pair of spaced apart end deck boards for providing deck coverage for the plurality of different size cargo cases.

The pattern may be defined by two pairs of first and second intermediate deck boards, with each intermediate deck board in each pair having a second width, and each pair of intermediate deck boards being adjacent one of the end deck boards. A pair of third intermediate deck boards may be between the two pairs of intermediate deck boards, with each third intermediate deck board having a third width. A fourth intermediate deck board may be between the pair of third intermediate deck boards, and having the second width.

The first and second widths may be within a range of about 3 to 4 inches. In one embodiment, the first and second widths may be equal. In another embodiment, the first and second widths may be different. The third width may be within a range of about 5 to 6 inches.

Positioning and size of the end and intermediate deck boards in the above described pattern advantageously provides a high percentage of coverage to support a broad range of cargo case sizes that may rest upon the cargo layer. This is particularly advantageous to pallets that are pooled.

A thickness of the end deck boards may be different from a thickness of the plurality of intermediate deck boards, whereas the intermediate deck boards preferably have a same thickness. The pallet may further comprise a base layer, and a plurality of spaced apart support blocks coupled between the base and cargo layers and forming a gap therebetween for receiving a lifting member. Each support block may comprise a stepped top surface so that an upper surface of the end deck boards and an upper surface of the plurality of intermediate deck boards are coplanar.

An advantage of the stepped top surface of the support blocks is that when an impact force is applied to an end deck board, the force is transmitted to the ends of the connector boards. As a result, the energy of the impact is dissipated over the length of the pallet. More specifically, the end grain of the connector boards absorb the impact force instead of the nail joints used to secure an end deck board to the support blocks. The stepped top surface thus improves the resiliency to impacts from material handling equipment as compared to a conventional block pallet.

Yet another aspect of the present invention is directed to a method for making a pallet comprising a cargo layer for supporting a plurality of different size cargo cases. The method comprises providing a pair of spaced apart end deck boards for the cargo layer, with each end deck board having a first width, and positioning a plurality of spaced apart intermediate deck boards in a pattern between the pair of spaced apart end deck boards in the cargo layer for providing deck coverage for the plurality of different size cargo cases.

The pattern may be defined by providing two pairs of first and second intermediate deck boards, with each intermediate deck board in each pair having a second width, and with each pair of intermediate deck boards being adjacent one of the end deck boards. A pair of third intermediate deck boards may be provided between the two pairs of intermediate deck boards, with each third intermediate deck board having a third width. A fourth intermediate deck board may be provided between the pair of third intermediate deck boards, and having the second width.

DETAILED DESCRIPTION OF THE PREFERRED EMBODIMENTS

Figure 1:
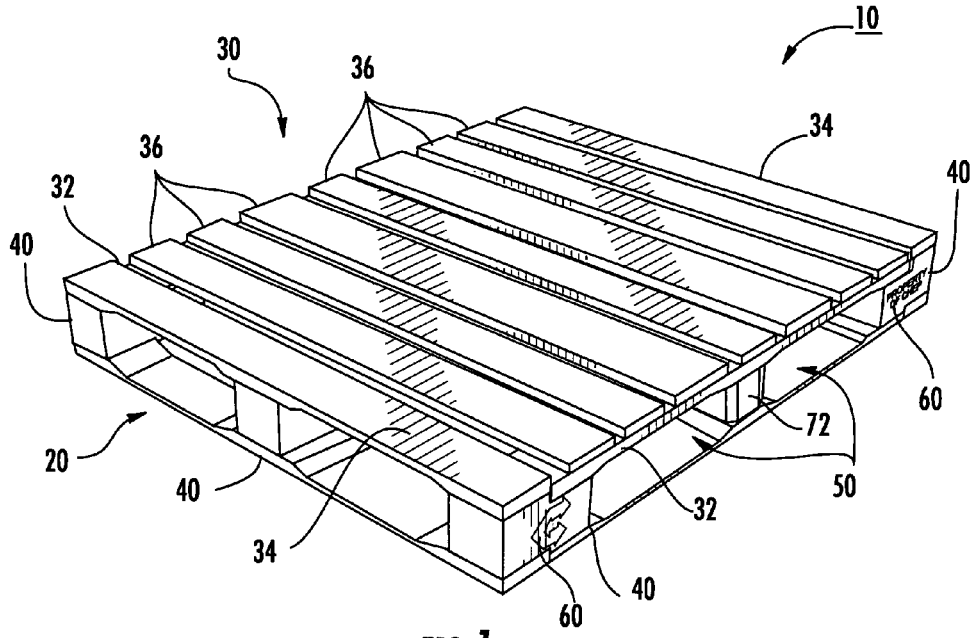
FIG. 1 is a top perspective view of a pallet in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

Referring initially to FIGS. 1-4, the pallet 10 in accordance with the invention comprises a base layer 20, a cargo layer 30 and a plurality of "stepped" support blocks 40. The support blocks 40 are coupled between the base and cargo layers 20, 30 and define a space 50 therebetween for receiving at least one lifting member of material handling equipment, such as a fork lift tine.

The pallet 10 is preferably made out of wood. However, other types of materials or composites may be used to form the pallet, as readily appreciated by those skilled in the art. These other materials and composites may or may not include wood. For purposes of discussion, the illustrated pallet 10 is made out of wood.

As will be discussed in greater detail below, the upper surface of the support blocks has multiple levels so that boards from the cargo layer 30 are coupled at different levels to the support blocks. This configuration of the support blocks is known as single stepped support blocks. Likewise, the lower surface of the support blocks may have multiple levels so that boards from the base layer 20 are coupled at different levels to the support blocks. This configuration of the support blocks is known double stepped support blocks. The single and double stepped support blocks advantageously improve the resiliency of the pallet 10 to withstand impacts from material handling equipment.

The cargo layer 30 comprises a pair of spaced apart connector boards 32, and a pair of spaced apart end deck boards 34 orthogonal to the connector boards so that the cargo layer has a rectangular shape. Each support block 40 comprises a stepped top surface including a first level 48*a* for receiving an end deck board 34, and a second level 48*b* for receiving a connector board 32. In addition to the pair of connector boards 32, additional support blocks 40 are positioned along the end deck boards 34 so that at least one more connector board 32 extends parallel to the pair of connector boards.

The stepped top surface of each support block 40 is configured so that the first level 48*a* is above the second level 48*b* with a transition wall 49 defined therebetween. As a result, an end of each connector board 32 is adjacent the transition wall 49 in the support block 40 coupled thereto. For manufacturing and assembly purposes, there is normally a tolerance gap between the transition wall 49 and the end of the corresponding connector board 32. However, the end deck boards 34 are normally positioned so that they butt up against ends of the connector boards 32.

When an impact force is applied to an end deck board 34, the force is transmitted to the ends of the connector boards 32 so that the energy of the impact is dissipated over the length of the pallet. More specifically, the end grain of the connector boards 32 absorb the impact force instead of the nail joints used to secure the end deck boards 34 to the support blocks 40. The stepped top surface thus improves the resiliency to impacts from material handling equipment as compared to a conventional block pallet.

The cargo layer 30 further comprises spaced apart intermediate deck boards 36 coupled to the connector boards 32. The intermediate deck boards 36 are substantially parallel to the end deck boards 34. An outer exposed top surface of the intermediate deck boards 36 is coplanar with outer exposed top surfaces of the end deck boards 34.

Another advantage of the stepped top surface of the support blocks 40 is that the thickness of the end deck boards 34 is independent of the thickness of the intermediate deck boards 36. This advantageously allows for thinner intermediate deck boards 36. The overall result is a lower cost pallet 10 that is more durable than a conventional block pallet.

Figure 5:
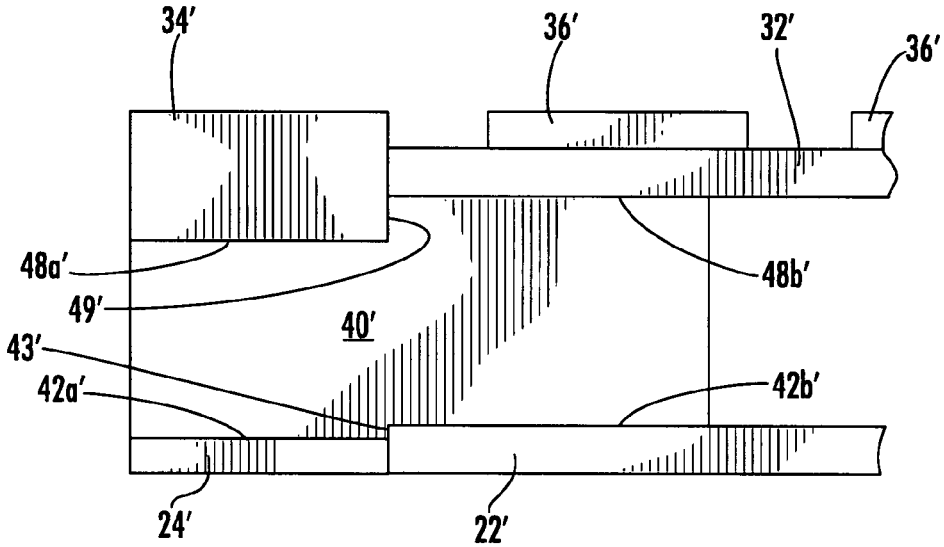
FIG. 5 is a side view of another embodiment of the support block in accordance with the present invention.

In an alternate embodiment, the stepped top surface of each support block 40' may be configured so that the first level 48*a*' is below the second level 48*b*' with a transition wall 49' defined therebetween, as shown in FIG. 5. This time, however, one side of each end deck board 34' is adjacent the transition wall 49' in the support blocks 40' coupled thereto.

Still referring to FIGS. 1-4, the base layer 20 comprises a pair of spaced apart end deck boards 24, and a pair of spaced apart connector boards 22 orthogonal to the end deck boards so that the base layer has a rectangular shape. Each support block 40 further comprises a stepped bottom surface including a first level 42*a* for receiving an end deck board 24 from the base layer, and a second level 42*b* for receiving a connector board 22 from the base layer.

The stepped top and bottom surfaces for each support block 40 thus defines a double stepped support block. The double stepped support block 40 advantageously improves the resiliency of the pallet 10 to withstand impacts from material handling equipment.

Figure 4:
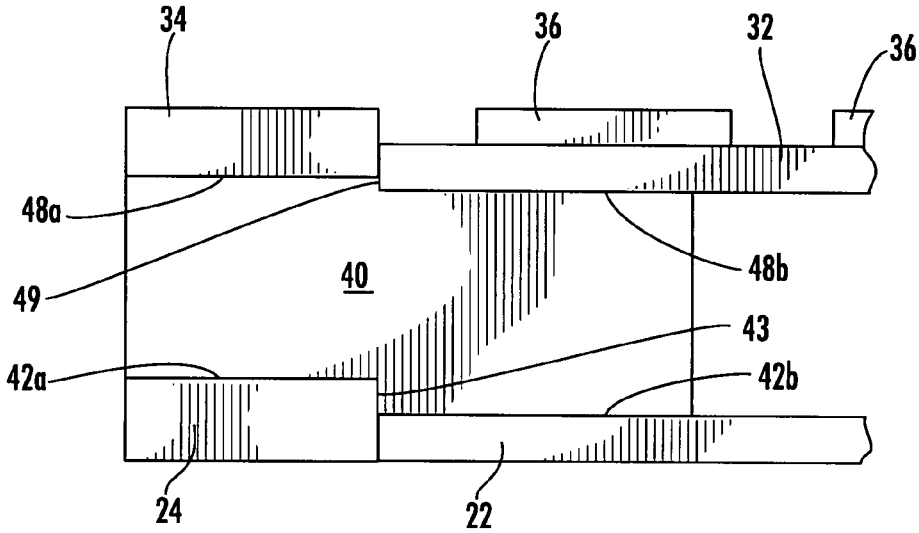
FIG. 4 is a side view of a support block shown in FIG. 1 with the end deck boards, the connector boards and the intermediate deck boards coupled thereto.

An outer exposed bottom surface of each connector board 22 and an outer exposed bottom surface of each end deck board 24 from the base layer 20 are coplanar. As best shown in FIG. 4, the stepped bottom surface of each support block 40 is configured so that the first level 42*a* is above the second level 42*b* with a transition wall 43 defined therebetween. As a result, one side of each end deck board 24 from the base layer 20 is adjacent the transition wall 43 in the support blocks 40 coupled thereto.

In an alternate embodiment, the stepped bottom surface of each support block 40' may be configured so that the first level 42*a*' is below the second level 42*b*' with a transition wall 43' defined therebetween, as shown in FIG. 5. This time, however, an end of each connector board 22' is adjacent the transition wall 43' in the support block 40' coupled thereto.

Figure 6:
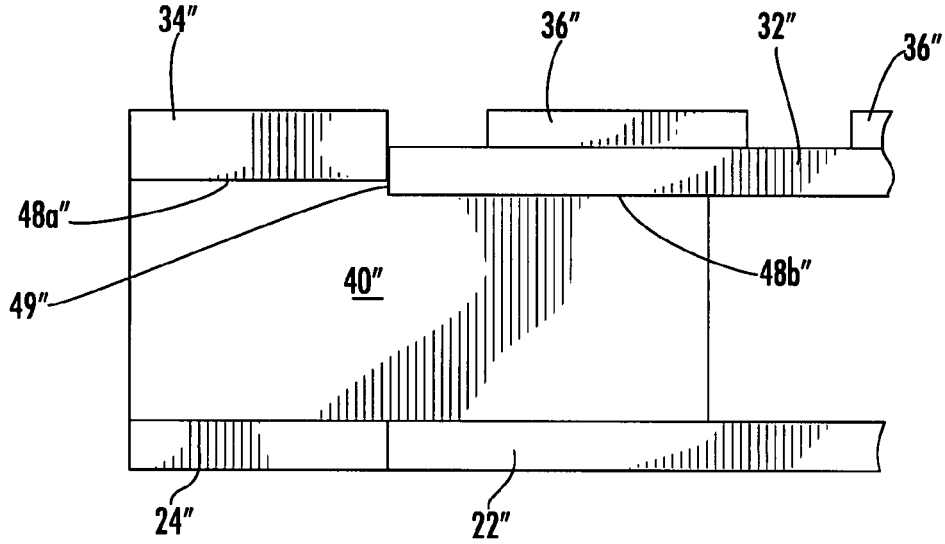
FIG. 6 is a side view of yet another embodiment of the support block in accordance with the present invention.

In yet another embodiment, the bottom surface of each support block 40" may be coplanar, as shown in FIG. 6. The end deck boards 24" and the connector boards 22" in the base layer 20" have the same thickness. In addition, the connector board 22" may butt up against the end deck board 24" in the base layer 20". In this embodiment, the end deck boards 24" and the connector boards 22" in the base layer 20" have the same thickness. This embodiment defines a single stepped support block 40". Even with a single stepped support block 40, the resiliency of the pallet 10 to withstand impacts from material handling equipment is advantageously improved as compared to a conventional block pallet.

The different levels of the first and second levels in the top surface of the support blocks, and the different levels of the first and second levels in the bottom surface of the supports blocks may be mixed and matched for a configuration not shown in the drawings. For example, the first level 48*a*' is below the second level 48*b*' in the top stepped surface of the support block as shown in FIG. 5, but the first level 42*a* may be above the second level 42*b* as shown in FIG. 4.

Figure 7:
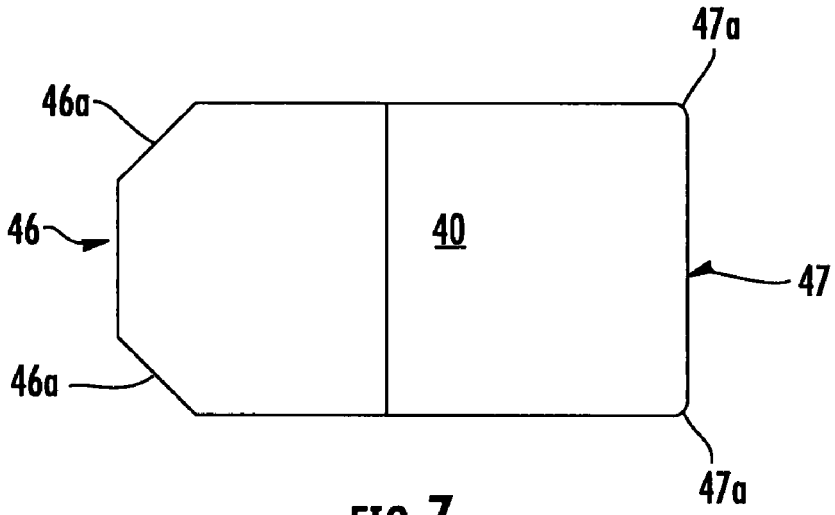
FIG. 7 is a top view of the support block in accordance with the present invention.

The edges of each support block 40 extending between the base layer 20 and the cargo layer 30 may be curved and/or angled, as best shown by the top view of the support block in FIG. 7. The inner face 46 of the support block 40 is inserted into the opening 50 of the pallet 10, and includes angled edges 46*a*. The angled edges 46*a* may be within a range of about 25 to 75 degrees, for example, to deflect the impact force of the forklift tines should such an impact occur. The illustrated edges are angled at 45 degrees.

Figure 2:
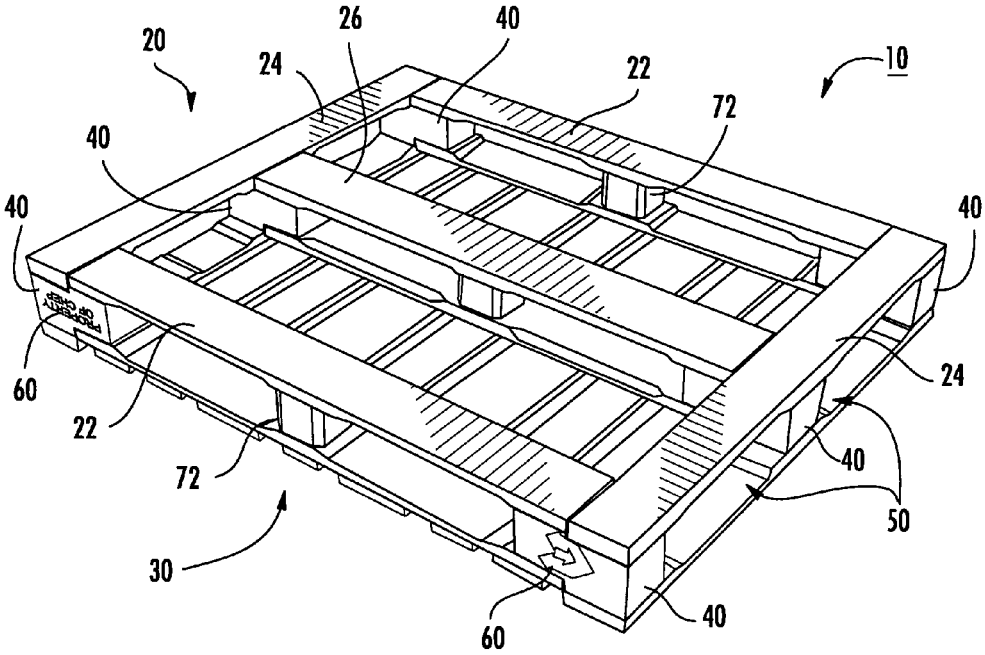
FIG. 2 is a bottom perspective view of the pallet shown in FIG. 1.
Figure 3:
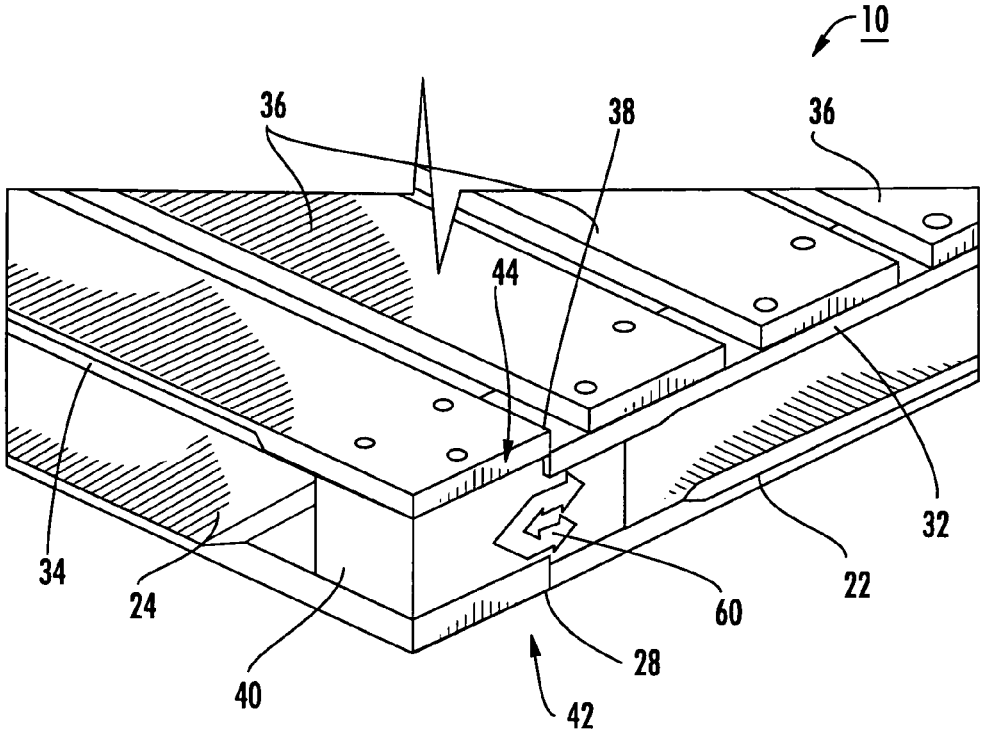
FIG. 3 is an enlarged perspective view of a corner of the pallet shown in FIG. 1.

The outer face 47 of the support block 40 facing away from the opening 50 of the pallet 10, and includes angled edges 47*a*. The angled edges have a curved radius within a range of about 2 to 12 mm, for example, and preferably within a range of about 4 to 8 mm. Indicia 60 may also be placed on the outer facing sidewalls of the support blocks 40, as shown in FIGS. 1-3. Alternatively, the edges of the support blocks 40 may all be angled or they may all be curved. Of course, the adjacent surfaces of the support block 40 defining an edge could be orthogonal to one another so that the edges or neither curved or angled. Instead, the edges of pointed.

The pallet 10 further comprises a plurality of intermediate support blocks 72 coupled between the base layer 20 and the cargo layer 32. Each intermediate support block 72 has coplanar top and bottom surfaces for receiving the respective connector boards 22, 32 from the base and cargo layers 20, 30.

Figure 8:
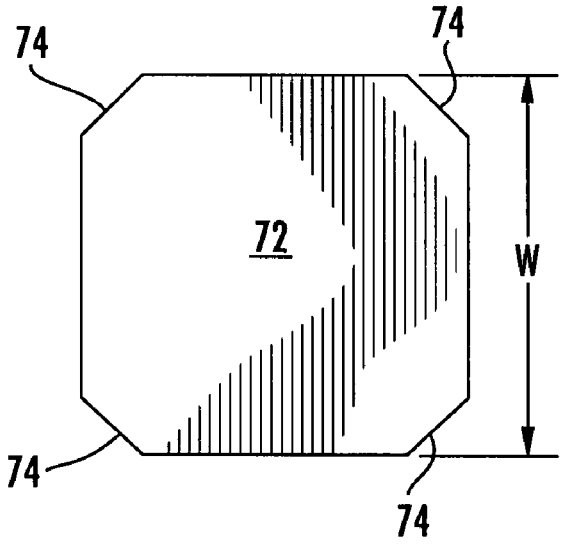
FIG. 8 is a top view of an intermediate support block in accordance with the present invention.

The intermediate support blocks 72 are rectangular shaped, as best shown by the top view in FIG. 8. The width w of each intermediate support block 72 is preferably the same width as the connector boards 22, 32 in the base and cargo layers 20, 30. The edges 74 of the intermediate support block 72 may be similar to the edges of the support blocks 40. As shown in FIG. 8, the edges are angled at 45 degrees, for example.

Another aspect of the invention is directed to making a pallet 10 comprising a base layer 20, and a cargo layer 30 comprising a pair of spaced apart end deck boards 34, and a pair of spaced apart connector boards 32 orthogonal to the pair of spaced apart end deck boards. The method comprises coupling a plurality of spaced apart support blocks 40 between the base and cargo layers 20, 30 and forming a gap therebetween for receiving a lifting member. Each support block 40 comprises a stepped top surface including a first level 48*a* for receiving an end deck board 34 and second level 48*b* for receiving a connector board 32 from the cargo layer 30.

Yet another aspect of the invention is directed to optimizing size and placement of the end deck boards 34 and the intermediate deck boards 36 for the cargo layer 30 of the pallet 10. Positioning and size of the deck boards 34, 36 in the cargo layer 30 provide a high percentage of coverage to support a broad range of products that may rest on the cargo layer. These products are typically packaged in cargo cases, for example.

Figure 9:
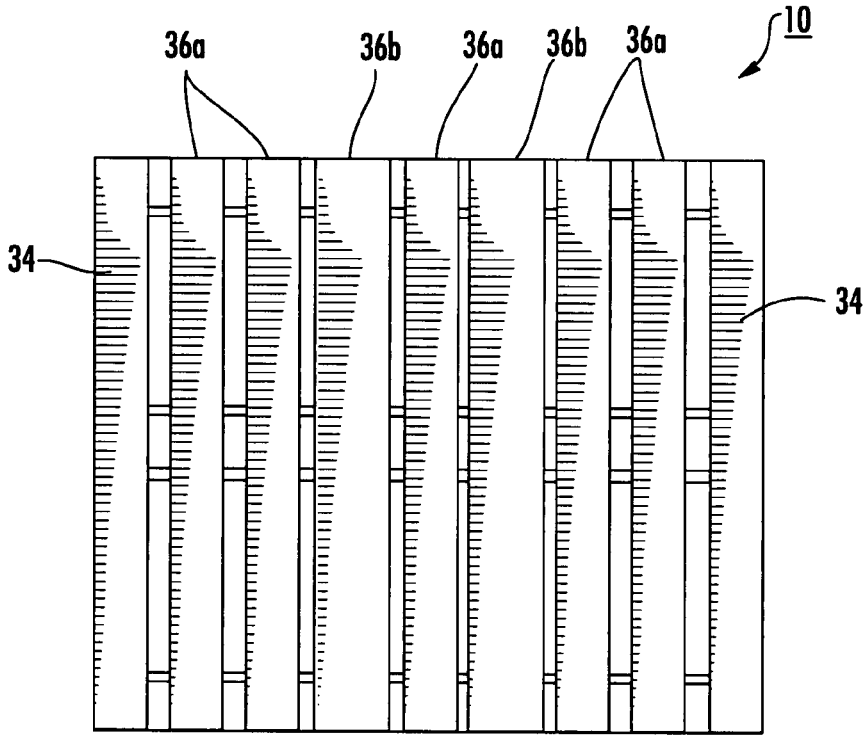
FIG. 9 is a top view of a pallet illustrating size and placement of the end deck boards and intermediate deck boards in the cargo layer in accordance with the present invention.
Figure 10:
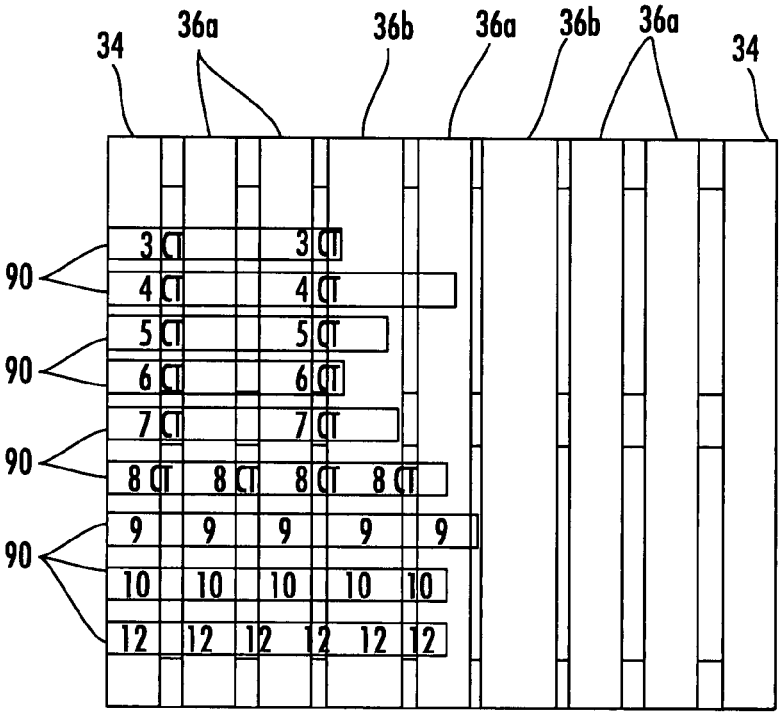
FIG. 10 is a top view of the pallet shown in FIG. 9 illustrating support of case corners for a variety of common case sizes.

In accordance with optimizing the cargo layer 30 of the pallet 10, the number and size of the intermediate deck boards 36 are to be minimized while achieving full corner support for common cargo case sizes. Referring now to FIGS. 9 and 10, two or more different size intermediate deck boards 36*a*, 36*b* and a specific pattern are used to achieve full support of cargo case corners for the most common cargo case sizes of 16", 12", 8" and 6". The cargo cases having different sizes are represented by reference 90.

Intermediate deck boards 36*a* are within a range of about 3 to 4 inches wide, whereas intermediate deck boards 36*b* are within a range of about 5 to 6 inches wide. The end deck boards 34 are also within a range of about 3 to 4 inches wide.

As illustrated in the figures, the width of the end deck boards 34 is 4 inches, the width of the intermediate deck boards 36*a* is 3.5 inches, and the width of the intermediate deck boards 36*b* is 5.5 inches. Alternatively, the end deck boards 34 may be the same width as the intermediate deck boards 36*a*, or vice-versa.

The illustrated pattern entails two 3.5 inch intermediate top deck boards 36*a*, followed by a 5.5 inch intermediate top deck board 36*b*, followed by a 3.5 inch intermediate top deck board, followed by another 5.5 inch intermediate top deck board, and then followed by two 3.5 inch intermediate top deck boards 36*a*.

The overall pattern of the intermediate top deck boards 36*a*, 36*b* with the end deck boards 34 define an outer exposed surface of the cargo layer 30 of overall dimensions 40 inches by 48 inches. The intermediate deck boards 36*a*, 36*b* are not limited to use with the illustrated support blocks 40. In other words, the optimized top deck pattern is applicable to pallets using conventional support blocks. Moreover, the optimized top deck pattern is also applicable to any type pallet design having a cargo layer.

In addition, other features relating to pallets are disclosed in the copending patent application filed concurrently herewith and assigned to the assignee of the present invention and is entitled PALLET WITH STEPPED SUPPORT BLOCKS AND RELATED METHODS, 11/678,806, the entire disclosure of which is incorporated herein in its entirety by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included as readily appreciated by those skilled in the art.

That which is claimed:

1. A pallet comprising:

a base layer;

a cargo layer configured to support a plurality of different size cargo cases, with the different size cargo cases having different corner widths to be directly supported by the cargo layer;

said cargo layer comprising a pair of spaced apart end deck boards, each end deck board having a first width, and a plurality of spaced apart intermediate deck boards positioned in a pattern between said pair of spaced apart end deck boards and configured to provide deck coverage so that the different corner widths for the plurality of different size cargo cases are directly supported by the plurality of spaced apart intermediate deck boards, and also spaced apart from said pair of end deck boards, the pattern defined by two pairs of first and second intermediate deck boards, each intermediate deck board in each pair having a second width, and each pair of intermediate deck boards being adjacent one of the end deck boards, a pair of third intermediate deck boards between the two pairs of intermediate deck boards, each third intermediate deck board having a third width different from the second width, and a fourth intermediate deck board between the pair of third intermediate deck boards, and having the second width, and said end deck boards having a thickness different from a thickness of said plurality of intermediate deck boards; and a plurality of spaced apart support blocks coupled between said base and cargo layers and forming a gap therebetween for receiving a lifting member, with each support block comprising a stepped top surface so that an upper surface of said end deck boards and an upper surface of said plurality of intermediate deck boards are coplanar.

2. A pallet according to claim 1 wherein the first width is equal to the second width.

3. A pallet according to claim 1 wherein the first and second widths are equal to about 3.5 inches.

4. A pallet according to claim 1 wherein the first and second widths are equal to about 4 inches.

5. A pallet according to claim 1 wherein the third width is equal to about 5.5 inches.

6. A pallet according to claim 1 wherein the second width is equal to about 3.5 inches, and the third width is equal to about 5.5 inches.

7. A pallet according to claim 1 wherein the second width is equal to about 4 inches, and the third width is equal to about 5.5 inches.

8. A pallet according to claim 1 wherein said plurality of intermediate deck boards have a same thickness.

9. A pallet according to claim 1 wherein said cargo layer comprises a pair of spaced apart connector boards orthogonal to said pair of spaced apart end deck boards; and wherein said plurality of intermediate deck boards is coupled to said pair of spaced apart connector boards.

10. A pallet according to claim 9 wherein the stepped top surface of each support block is configured so that the first level is above the second level with a transition wall defined therebetween; and wherein an end of each connector board is adjacent the transition wall in the support block coupled thereto.

11. A pallet comprising:

a base layer;

a cargo layer configured to support a plurality of different size cargo cases, with the different size cargo cases having different corner widths to be directly supported by the cargo layer, and comprising a pair of spaced apart end deck boards each having a first width, and a pair of spaced apart connector boards orthogonal to said pair of spaced apart end deck boards; and a plurality of spaced apart support blocks coupled between said base and cargo layers and forming a gap therebetween for receiving a lifting member;

said cargo layer further comprising a plurality of spaced apart intermediate deck boards positioned in a pattern on said pair of connector boards and between said pair of spaced apart end deck boards and configured to provide deck coverage so that the different corner widths for the plurality of different size cargo cases are directly supported by the plurality of spaced apart intermediate deck boards, and also spaced apart from said pair of end deck boards, the pattern defined by two pairs of first and second intermediate deck boards, each intermediate deck board in each pair having a second width, and each pair of intermediate deck boards being adjacent one of the end deck boards, a pair of third intermediate deck boards between the two pairs of intermediate deck boards, each third intermediate deck board having a third width different from the second width, and a fourth intermediate deck board between the pair of third intermediate deck boards, and having the second width; and each support block comprising a stepped top surface including a first level for receiving an end deck board and second level for receiving a connector board, with an outer exposed top surface of said plurality of intermediate deck boards being coplanar with outer exposed top surfaces of said pair of end deck boards.

12. A pallet according to claim 11 wherein the first and second widths are within a range of about 3 to 4 inches.

13. A pallet according to claim 12 wherein the first and second widths are equal.

14. A pallet according to claim 12 wherein the first and second widths are not equal.

15. A pallet according to claim 11 wherein the third width is within a range of about 5 to 6 inches.

16. A pallet according to claim 11 wherein a thickness of said end deck boards is different from a thickness of said plurality of intermediate deck boards.

17. A pallet according to claim 11 wherein said plurality of intermediate deck boards have a same thickness.

18. A pallet according to claim 11 wherein the stepped top surface of each support block is configured so that the first level is above the second level with a transition wall defined therebetween; and wherein an end of each connector board is adjacent the transition wall in the support block coupled thereto.

19. A method for making a pallet comprising a base layer, and cargo layer configured to support a plurality of different size cargo cases, with the different size cargo cases having different corner widths to be directly supported by the cargo layer, the method comprising:

providing a pair of spaced apart end deck boards for the cargo layer, each end deck board having a first width;

positioning a plurality of spaced apart intermediate deck boards in a pattern between the pair of spaced apart end deck boards in the cargo layer and configured to provide deck coverage so that the different corner widths for the plurality of different size cargo cases are directly supported by the plurality of spaced apart intermediate deck boards, and also spaced apart from the pair of end deck boards, the pattern defined by providing two pairs of first and second intermediate deck boards, each intermediate deck board in each pair having a second width, and each pair of intermediate deck boards being adjacent one of the end deck boards, providing a pair of third intermediate deck boards between the two pairs of intermediate deck boards, each third intermediate deck board having a third width different from the second width, and providing a fourth intermediate deck board between the pair of third intermediate deck boards, and having the second width;

the end deck boards having a thickness different from a thickness of the plurality of intermediate deck boards; and coupling a plurality of spaced apart support blocks coupled between the base and cargo layers and forming a gap therebetween for receiving a lifting member, with each support block comprising a stepped top surface so that an upper surface of the end deck boards and an upper surface of the plurality of intermediate deck boards are coplanar.

20. A method according to claim 19 wherein the first and second widths are within a range of about 3 to 4 inches.

21. A method according to claim 19 wherein the third width is within a range of about 5 to 6 inches.

22. A method according to claim 19 wherein the plurality of intermediate deck boards has same thickness.

23. A method according to claim 19 further; wherein the cargo layer comprises a pair of spaced apart connector boards orthogonal to the pair of spaced apart end deck boards; and wherein the plurality of intermediate deck boards is coupled to the pair of spaced apart connector boards.

24. A method according to claim 23 wherein the stepped top surface of each support block is configured so that the first level is above the second level with a transition wall defined therebetween; and wherein an end of each connector board is adjacent the transition wall in the support block coupled thereto.

* * * * *